US006244524B1

(12) United States Patent
Tackels et al.

(10) Patent No.: US 6,244,524 B1
(45) Date of Patent: Jun. 12, 2001

(54) FUEL INJECTION BURNER

(75) Inventors: Guy Tackels, Nanterre; Patrick Rouchy, Vaucresson; Joseph Vernaz, En Bugey, all of (FR)

(73) Assignee: Saint-Gobain Glass France, Courbevoie (FR)

( * ) Notice: Subject to any disclaimer, the term of this patent is extended or adjusted under 35 U.S.C. 154(b) by 0 days.

(21) Appl. No.: 09/206,322

(22) Filed: Dec. 7, 1998

(30) Foreign Application Priority Data

Dec. 5, 1997 (FR) ..... 97 15403
Feb. 11, 1998 (FR) ..... 98 01593

(51) Int. Cl.[7] ..... B05B 7/10; B05B 7/06

(52) U.S. Cl. ..... 239/403; 239/416.4; 239/416.5; 239/421; 239/423; 239/424; 239/424.5; 239/468; 239/482; 239/488; 239/494; 239/497

(58) Field of Search ..... 239/403, 416.4, 239/416.5, 421, 423, 424, 424.5, 468, 482, 488, 494, 497, 401

(56) References Cited

U.S. PATENT DOCUMENTS

Re. 30,004 * 5/1979 Reed .
2,103,958 * 12/1937 Stillman .
2,246,211 * 6/1941 Kilich .
3,477,647 * 11/1969 Grundman et al. .
3,785,570 * 1/1974 Krieger ..... 239/401
3,799,449 * 3/1974 Gardner .
4,419,074 * 12/1983 Schuetz .
4,474,331 * 10/1984 Aprea et al. .
5,044,558 * 9/1991 Young et al. ..... 239/391
5,058,808 * 10/1991 Young ..... 239/464
5,067,657 * 11/1991 Young et al. .
5,234,168 * 8/1993 Abboud .
5,251,823 * 10/1993 Joshi et al. ..... 239/401
5,813,847 * 9/1998 Eroglu et al. ..... 431/8
6,045,058 * 4/2000 Dobbeling et al. ..... 239/11

* cited by examiner

*Primary Examiner*—Sean E Vincent
(74) *Attorney, Agent, or Firm*—Oblon, Spivak, McClelland, Maier & Neustadt, P.C.

(57) ABSTRACT

In a combustion process, especially one used for melting glass, the delivery of fuel is ensured by an apparatus having at least one burner (5) which is equipped with at least one injector (1) that includes a liquid fuel delivery tube (2) which has at least one internal wall (25) and an injected fluid delivery tube (3) arranged concentrically with respect to the liquid fuel delivery tube. Immediately before injecting the liquid fuel from its delivery tube, one puts it in the shape of a hollow jet basically assuming the shape of the internal wall. This has application for the reduction of $NO_x$ in a glass-making oven.

13 Claims, 2 Drawing Sheets

FUEL INJECTION BURNER

BACKGROUND OF THE INVENTION

1. Field of the Invention

This invention pertains to a combustion process and a device in which the fuel supply is provided by at least one burner equipped with at least one injector.

The invention will be described specifically for use in melting glass in glass-making ovens, particularly ovens used for making float-type flat glass or ovens used to make hollow glass containers, for example, ovens that operate opposite to the type of ovens that use regenerators (energy recovery devices). However, the invention is not necessarily limited to such applications.

2. Description of the Related Art

The majority of combustion processes of the aforementioned type, particularly those used in glass-making ovens, are confronted with problems of undesirable $NO_x$ emissions. $No_x$ emissions are harmful to humans and to the environment. Indeed, $NO_2$ is an irritating gas that causes respiratory ailments. Additionally, in contact with the atmosphere, these gases can gradually form acid rain. Finally, they cause photochemical pollution since in combination with volatile organic compounds and solar radiation, the $NO_x$ gases are the basis for the formation of so-called tropospheric ozone which, in increased concentration at low altitude, becomes harmful for human beings, especially when it is very hot.

All these factors mean that the standards with respect to $NO_x$ emissions are becoming increasingly restrictive. Currently, because of said standards, oven manufacturers such as those that manufacture glass-making ovens are constantly concerned with limiting the maximum level of $NO_x$ emissions, preferably at a rate less than 500 mg/m$^3$.

The parameters that influence the production of $NO_x$ gases are known. One such parameter is temperature; beyond 1300° C., the emission of $NO_x$ gases increases exponentially with excess air, since the concentration of $NO_x$ gases depends on the square root of that of oxygen or even the concentration of $N_2$.

Many techniques have been proposed to reduce $NO_x$ emissions. One involves causing a reducing agent to convert the $NO_x$ gases to nitrogen. This reducing agent can be ammonia, but this has disadvantages including difficulties with storage and handling of such a product. It is also possible to use a natural gas as a reducing agent, but this has detrimental effects on the fuel consumption rate of the oven and increases the $CO_2$ emissions.

Therefore it is preferable, although not mandatory, to avoid this technique by adopting the so-called primary measures. These measures are called "primary" because one does not attempt to destroy the $NO_x$ gases that are already formed, as in the previously described technique. Rather, one tries to prevent their formation, for example at the flame level. Additionally, these measures are simpler to implement and, consequently, more economical. They do not have to completely substitute for the aforementioned technique but can advantageously complement it. These primary measurements in general amount to an indispensable precondition for reducing the consumption of reagents of the secondary measures.

One can categorize, in a non-limiting way, the existing measures in several categories:

A primary category consists of reducing the production of $NO_x$ gases via the so-called "reburning" technique by which one creates an air-deficient zone at the oven combustion chamber level. This technique has the disadvantages of increasing the temperature at the regenerator stack and of requiring a specific design of the regenerators and their stacks, especially in terms of airtightness and resistance to corrosion.

A second category consists of affecting the flame by reducing or preventing the formation of $NO_x$ gases at that level. To do this one can, for example, attempt to reduce the amount of excess combustion air. It is also possible to attempt to limit the temperature peaks by maintaining the flame length and to increase the volume of the flame front in order to reduce the average temperature within the flame. Such a solution is, for example, described in French patent application FR 96/08663 and international application PCT/FR/97 01244, which were filed on Jul. 11, 1996 and Jul. 9, 1997, respectively. The solution consists of a combustion process for melting glass in which the liquid fuel supply and the supply of the gas and air mixture are both brought about in such a way as to spread out periodically the liquid fuel/gas-air mixture contact and/or to increase the volume of this contact in order to reduce $NO_x$ emissions.

SUMMARY OF THE INVENTION

It is an object of the invention to provide a new combustion process and device in which the fuel used is liquid, allowing one to make the flame longer and/or to reduce the temperature peaks inside the flame in order to reduce the formation of $NO_x$ gases.

Another object of the invention is to propose a combustion process and that are adjusted to all of the existing glass-making oven configurations. This will allow one to obtain an optimal thermal transfer, particularly by providing a flame of adequate length and of sufficiently great volume in order to enhance maximum coverage of the bath of substances which can be vitrified when melted.

In order to accomplish these and other objects, the invention provides a combustion process, particularly one used for melting glass, in which the fuel supply is provided by at least one burner equipped with at least one injector that includes a liquid fuel delivery tube which has at least one internal wall and one injection fluid delivery tube arranged concentrically with respect to the liquid fuel delivery tube. Immediately before ejecting the liquid fuel is ejected from its delivery tube, it is formed into a hollow jet that substantially takes on the shape of said internal wall. This perfectly resolves the problem presented. By creating a very specific flow of liquid fuel immediately before it goes out of its delivery tube, there results an increased amount of mechanical injection of the liquid fuel by the injection fluid at its outlet from this tube, resulting in heterogeneity of the drops of the fuel, and thereby avoiding burning occurring at too high a speed, which is a source of the formation of $NO_x$ gases. Consequently, for a desired flame temperature one can allow less fuel to be delivered to the intake and therefore to the flame base, which will also reduce the risk of the formation of $NO_x$ gases.

The method according to the invention does not necessarily substitute for the existing techniques but can, if necessary, complement them quite advantageously.

According to an advantageous characteristic of the invention, the liquid fuel is ejected at a delivery driving pressure of at least 1.2 MPa.

Whatever the particular configuration of the oven in which the process of the invention is implemented, one should ensure atomization of the liquid fuel necessary to avoid too rapid a burning rate.

In a preferred manner, the liquid fuel should be ejected at a temperature between 100 and 150° C., preferably between 120 and 135° C. Such a temperature range allows one to introduce any kind of liquid fuel that is used in traditional units, particularly in glass-making ovens, at the required viscosity immediately before it is injected from its delivery tube. This viscosity can advantageously be at least equal to $5 \cdot 10^{-6}$ $m^2/s$, especially between $10^{-5}$ and $2 \cdot 10^{-5}$ $m^2/s$.

According to another characteristic of the invention, the liquid fuel is ejected at an opening angle cone of at least 10°, especially between 10° and 20°. Such values allow, independent of the geometry of the liquid fuel delivery tube and its dimensions, both the necessary systematic interference between the jet of injection fluid and the liquid fuel drops, and a dispersion of the size of these drops which is optimal, so that the resulting flame will be homogeneous in temperature over its entire length.

As for the injection fluid, one can eject it in a very advantageous manner at a flow rate of more than 40 $Nm^3/h$. Obviously, the value of the injection fluid flow rate is correlated with that of the pressure of this fluid, a pressure that should be limited as much as possible. By having a maximum flow rate value, as previously mentioned, one could obtain a sufficient flame length for all oven configurations of existing glass-making ovens.

The invention also comprises a burner equipped with at least one injector, especially one that is capable of implementing the already-described process. This includes a liquid fuel delivery tube, of the fuel oil type, which has at least one internal wall and one injection fluid delivery tube arranged concentrically with respect to the liquid fuel delivery tube. The liquid fuel delivery tube should include at least one means for inserting the liquid fuel in the form of a hollow jet, which substantially takes on the shape of the internal wall immediately before ejection.

According to one embodiment, the liquid fuel delivery tube includes at least one cylindrical tube. In this case, the inserting means will advantageously include a nozzle that is attached, preferably via screwing, to the end of the cylindrical tube. A geometry of the nozzle which is particularly well suited for the burner in accordance with the invention includes a truncated conical, swirling chamber at its downstream end that is extended by a tip whose internal wall is cylindrical.

It should be noted that the terms "downstream" and "upstream" must be understood by reference to the liquid fuel delivery direction. Therefore, the downstream end of the nozzle designates the end that is farthest from the supply source of the liquid fuel and, therefore, nearest to the place where the fuel is ejected from its delivery tube. In a particularly preferred manner, the angle $\theta$ at the tip of the swirling chamber is at least 30°, preferably equal to 60°, which allows one to minimize the losses of the liquid fuel load during its delivery flow.

According to a preferred variant of the invention the inserting means includes at least one element which substantially closes the liquid fuel delivery tube and is perforated by channels, especially cylindrical ones, which are oblique with respect to the liquid fuel delivery direction. This element, because of its particular geometry, confers on the liquid fuel a flow pattern in conformity with that which precedes it and gives it a sufficiently great mechanical energy level so that it can be sprayed at the outlet from its delivery tube in the form of droplets whose size dispersion rate is optimal. The channels can advantageously be uniformly distributed over the circumference of the component.

This component has a shape that allows its insertion in the liquid fuel delivery tube and can, for example, be a cylinder, preferably with two sides that are approximately parallel to one another. The sides are preferably oriented in a direction perpendicular to the direction of the liquid fuel delivery direction.

More advantageously, the orientation of each of the channels is selected so that their generatrix will make an angle $\alpha$ of at least 10°, especially between 15 and 30°, and preferably equal to 20°, with the liquid fuel delivery direction. This particular orientation will allow one to obtain a synergy between all of the "divided" jets of liquid fuel at their outlet from the corresponding channels so that when they strike the downstream part of the delivery tube, in particular the swirling chamber of the aforementioned nozzle, they will not interfere with one another and will work together for the creation, downstream, of a single hollow jet that assumes the shape of the internal wall.

According to an additional characteristic, the component can be installed upstream from the nozzle in an airtight manner in the liquid fuel delivery tube, preferably opposite the swirling chamber.

The injection fluid delivery tube preferably includes at least one cylindrical tube at the end of which there is attached, preferably by screwing, a section perforated by an opening in which at least one part of the nozzle in accordance with the invention is inserted. Preferably the opening of the section in the external wall of the part of the nozzle which is inserted therein is arranged concentrically. This preferred arrangement can also be produced by the aforementioned screwing which is capable of ensuring self-centering of the previously described components, that is, the opening of the section with respect to the part of the nozzle which is inserted in it.

This concentricity is advantageous to the extent that if it is not available there will be a risk of the formation of very large droplets of liquid fuel, of the fuel oil type, on the periphery of the hollow jet, which will cause incomplete combustion with an increase in carbon monoxide.

Also, it is preferable that the terminal section of the nozzle be perfectly aligned in the plane defined by the side of the section that does not have contact with the injection fuel and where the opening begins. Incorrect alignment implies modification of the aerodynamics of the liquid fuel and of the injection fluid at their outlet from their respective delivery tubes.

Advantageously, the injector in conformity with the invention is installed in an airtight manner in a section of refractory material via a sealing device which includes a plate provided with cooling fins. Such an airtight installation prevents any intake of parasitic air at the level of the downstream end of the injector, parasitic air being particularly harmful in that it will increase the oxygen content at the flame root, which comprises the hottest section of the flame.

According to another characteristic, the burner in conformity with the invention also includes an adjustable support on which the previously described injector is attached and a ventilation nozzle oriented toward the downstream end of the injector, more particularly toward the aforementioned plate. The support is preferably adjustable by inclination, by azimuth, and by translation, especially so that it can rest on the plate of the airtight device. The ventilation nozzle blows out air, allowing one to avoid excessive heating locally at the level of the downstream end of the injector.

The invention also comprises a burner equipped with at least one injector that includes a liquid fuel delivery tube, of the fuel oil type, which has at least one internal wall and one injection fluid delivery tube arranged concentrically with respect to the liquid fuel delivery tube, notable in that the liquid fuel delivery tube includes at least one diffuser.

The advantages introduced by the above-described burner are undeniable. In addition to the fact that it produces less $NO_x$ gases than previously in the combustion chamber, for example an oven, it requires a lower injection fluid flow rate. This facilitates greater and more flexible use of the gas-air mixture and, therefore, allows one to obtain better results from an energy use standpoint.

The invention applies to all types of oven configurations, particularly glass-making ovens such as loop ovens, transverse burner oven, and inversion ovens. It is used in particular to reduce the emission of $NO_x$ gases.

Finally, it greatly complements the technique described in French patent application FR 96/08663 and international application PCT/FR97/01244 mentioned earlier, a technique that belongs to the technology developed by Saint-Gobain Vitrage Company under the name "Fenix."

BRIEF DESCRIPTION OF THE DRAWINGS

Other details and advantageous characteristics of the invention will be apparent subsequently from reading the implementation example, which is non-limiting, and is described in reference to the attached figures in which.

DETAILED DESCRIPTION OF THE PREFERRED EMBODIMENTS

Figure 1:
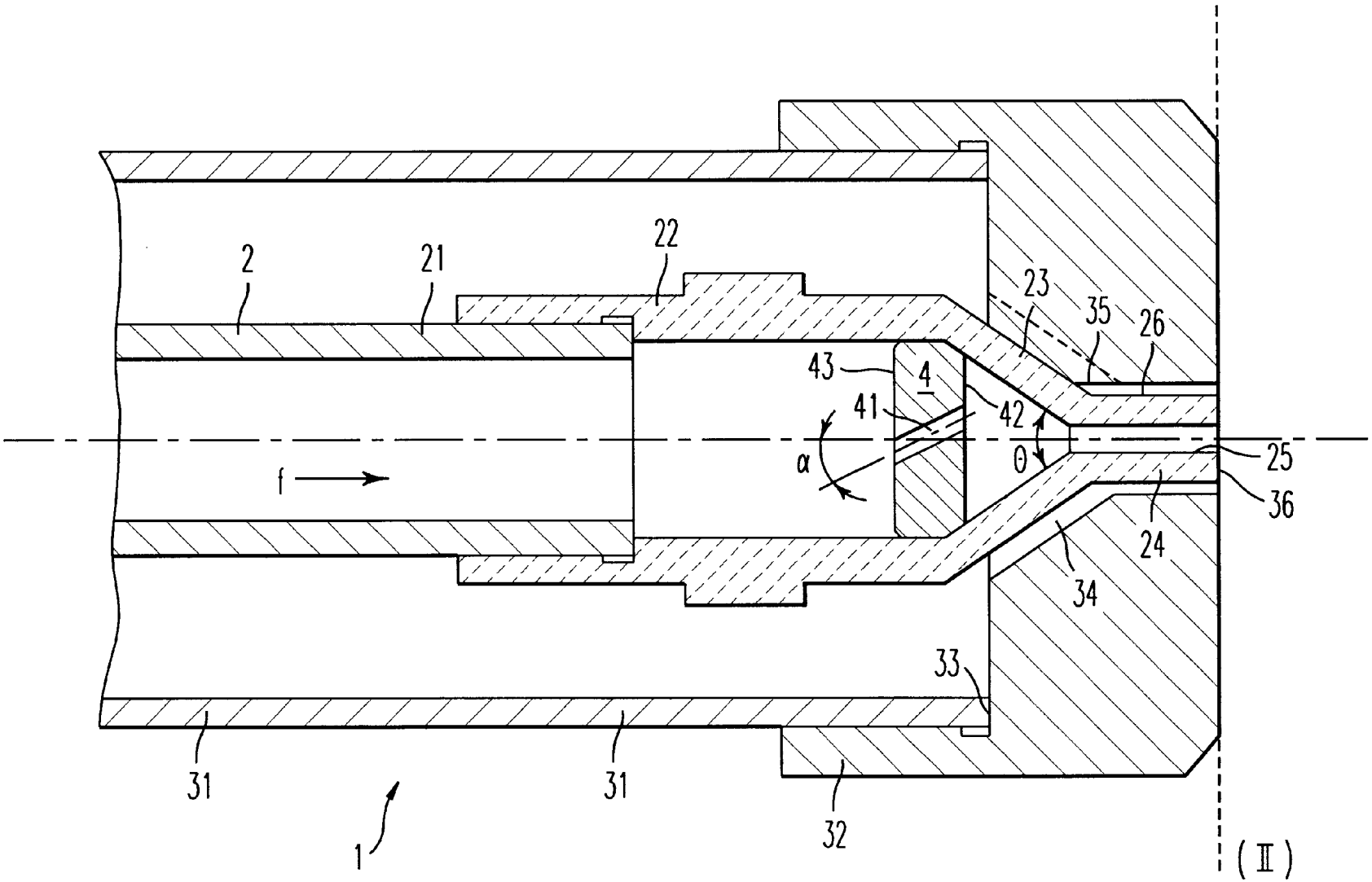
FIG. 1 is a schematic partial sectional view of an injector according to the invention.
Figure 2:
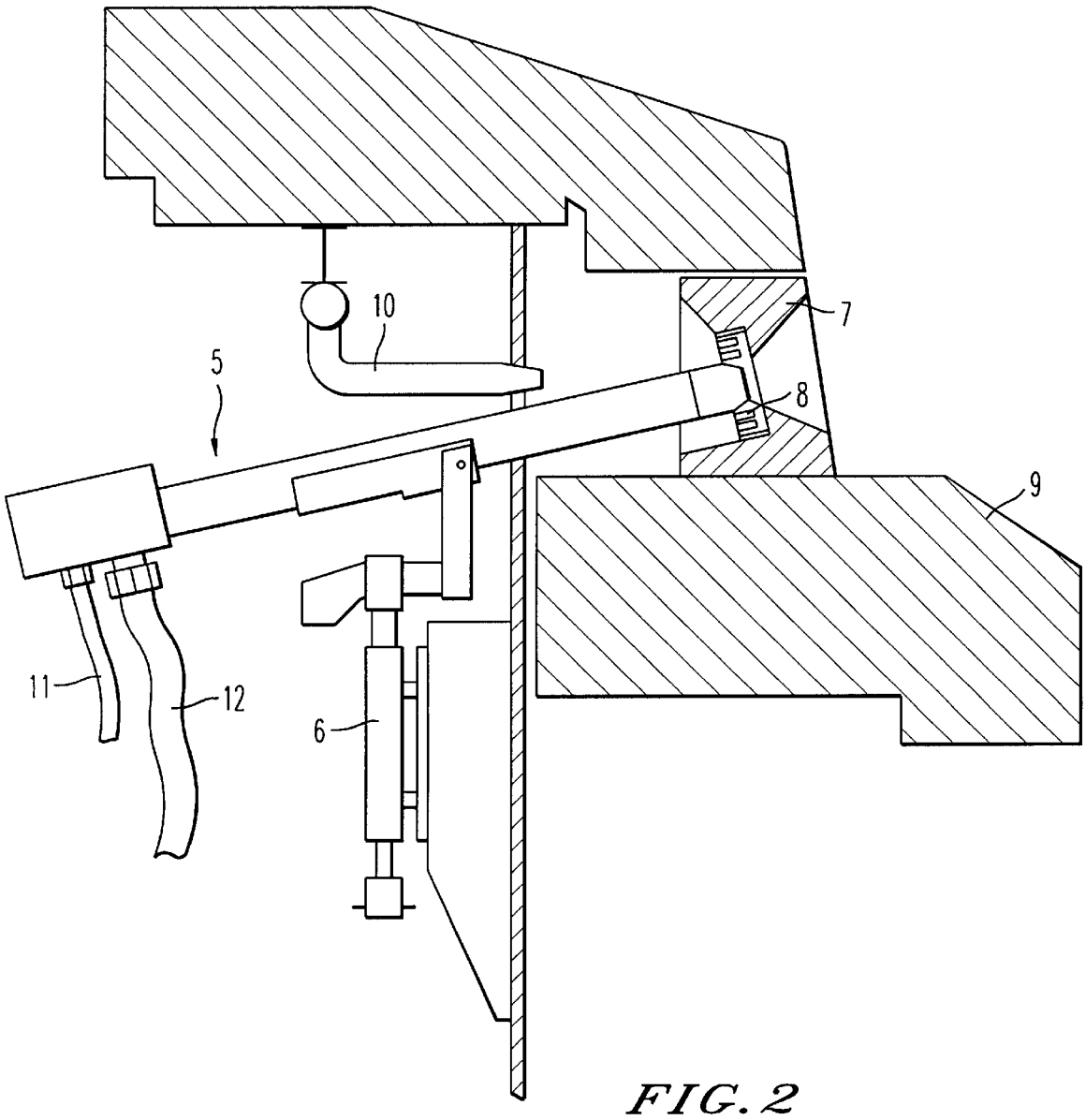
FIG. 2 is a vertical top view of one wall of a glass-making oven, which includes a burner equipped with the injector in accordance with FIG. 1.

For the sake of clarity, it should be noted that FIGS. 1 and 2 are schematic and do not maintain the relative proportions between the different components.

FIG. 1 is a partial cross-sectional view of an injector 1 in conformity with the invention. This injector 1 has two fluid supplies which are respectively the liquid fuel delivery tube 2 and an injection fluid delivery tube 3. The liquid fuel and injection fluid delivery tubes are respectively connected to sources of the respective fluids.

The liquid fuel may be a liquid fossil fuel currently used in combustion devices to heat vitrifiable materials in a glass-making oven. For example, it could be heavy fuel oil. The injection fluid may be that which one normally finds in existing units and which is used to spray the liquid fuel. This may be air (called primary air in contrast to secondary air, which is used as the main gas-air mixture). It can also be oxygen (in the case of oxygen combustion) or a vapor.

The liquid fuel delivery tube 2 comprises a cylindrical tube 21, on the end of which a nozzle 22 is screwed. The latter includes at its downstream end a truncated conical portion 23 forming a swirling chamber. It is extended by a tip 24 with cylindrical internal wall 25. The angle θ of the cone 23 at the tip of the swirling chamber is equal to 60°, a value selected for the already-explained reasons.

Inside the nozzle 22 is arranged a cylindrical plug 4 installed in an airtight manner at the stop defined by the tapering of the cone 23. The plug 4 includes channels 41 that are uniformly distributed over its circumference. The plug has two sides 42, 43 which are parallel to one another and approximately perpendicular to the delivery direction of the liquid fuel (symbolized by the arrow "f " in FIG. 1), a direction which is otherwise identical to that of the injection fluid.

The channels 41 are cylindrical; their lengths make an angle α of 20° with the previously mentioned delivery direction.

The injection fluid delivery tube 3 consists essentially of a cylindrical tube 31. A section 32 is screwed on the end of the injection fluid delivery tube 3 via an internally threaded flange until a shoulder 33 comes to stop against the downstream end of tube 31. Section 32 is perforated by an opening 34 which has a shape that allows it to contain a part of the nozzle 22. That is, the side of opening 34 have projecting portions 35 which have the shape of the cone 23. As a result, upon screwing the section 32 onto the cylindrical tube 31, the projecting portions 35 engage the cone 23 to ensure perfect self-centering of the external wall 26 of the tip 24 inside the opening 34. That is, because of the complementary shapes of parts 23 and 35, the concentricity of the components 26 and 34 is perfectly assured, which allows one to avoid an undesirable size dispersion of the liquid fuel droplets from tube 2.

The thickness of the portion of section 32 between the surface in contact with the cylindrical tube 31 and the plane II must be calculated precisely so that the alignment of the terminal part 36 of the nozzle in the plane II is perfectly achieved. This plane II is that defined by the external side 37 of the unit, at which the opening 34 emerges. This contributes to preserving the aerodynamics of the two fluids at their outlet from their respective delivery tubes.

Referring to FIG. 2, which shows a vertical top view of one wall of a glass-making oven which includes a burner 5 equipped with the injector in conformity with FIG. 1, one can see that the burner 5 includes a support 6 which is adjustable in inclination, in azimuth and in translation. On this adjustable support 6 is secured the injector 1 which is supported against the refractory walls of a unit 7 by way of a plate 8 provided with cooling fins. The unit 7 is itself installed in an opening of the wall of oven 9. The burner 5 also includes a ventilation nozzle 10 oriented toward the plate 8.

Two flexible delivery pipes 11 and 12 are connected respectively between the liquid fuel and injection fluid supply sources, and the tubes 2 and 3.

Functioning of the burner will now be explained as follows:

The liquid fuel delivered via cylindrical tube 21 is divided by the channels 41 in the plug 4 into a plurality of individual jets. The individual jets strike the walls of the swirling chamber in the cone 23 with a minimum pressure loss because the angle θ is equal to 60°. This is because the uniform distribution of the tangential channels 41 and their inclination angle α of 20° causes a swirling of the individual jets against the wall of the swirling chamber 23 without interfering with one another. This swirling or centrifuging in the swirling chamber contributes to a downstream spiral trajectory of the fuel, so that the fuel forms a hollow jet that nearly perfectly assumes the shape of the internal wall 25 of the tip 24.

At the outlet from tip 24, the liquid fuel therefore has acquired the maximum mechanical energy and, due to the influence of the injection fluid, breaks up into very fine droplets whose size dispersion is optimal. This dispersion makes the flame coming from the burner, once the main gas-air mixture activates it, homogeneous in temperature over its entire length.

Additionally, such injection spraying of the fuel considerably extends, given the same fuel flow rate, the flame as compared to spraying by the same injector 1 without plug 4.

The dimensions of plug 4 must be made so that there always results a hollow jet that substantially assumes the shape of this internal wall. The parameters that include the number, inclination α, and the size of the channels 41 must be determined as a function of the desired flow rate of injector 1. This desired flow rate is itself determined from the type of oven on which one desires to install the injector, its operating parameters such as the draft, as well as the type of liquid fuel being used.

These values can be established by one skilled in the art, empirically through routine experimentation and without any difficulty. A person of the art will also be able to select a surface condition for the swirling chamber, of the channels and of the tip of the internal walls, being careful to ensure a minimum of pressure losses due to friction of the liquid fuel jet(s) which flow against these components at high speed.

The injector that has just been described has a simple and not very expensive design. It is, in addition, completely and easily taken apart and adjustable to preexisting units.

The previously described oven will produce far fewer $NO_x$ gases without fear of a impairing combustion, which could possibly be harmful to the tint of the glass.

The combustion process and the burner, in accordance with the invention, are particularly well adjusted to the fabrication of high quality glass, especially optical glass, such as flat glass produced by flotation.

The invention pertains particularly to fuels of the heavy fuel type and it allows one to cause circulation of very high flow rate (500 to 600 kg/h) or this type of fuel with a single injector.

Of course, various modifications can be introduced without thereby departing from the scope of the invention, which includes injection of a liquid fuel taking the form of a hollow jet immediately before being injected by means of an injection fluid such as air, whose delivery is ensured so that it will exit exclusively along the axis of the internal wall of the fuel delivery tube without any spiral component.

What is claimed is:

1. A burner equipped with at least one injector comprising:

a liquid fuel delivery tube terminating in a downstream nozzle which has a swirling chamber of truncated cone shape extended by a cylindrical tip having an internal wall;

a atomizing fluid delivery tube arranged concentrically with respect to said liquid fuel delivery tube;

at least one atomizing element cooperating with said liquid fuel delivery tube and configured for forming the liquid fuel as a hollow jet which substantially assumes the shape of said internal wall, immediately before the liquid fuel is injected from said liquid fuel delivery tube; and a unit perforated by an opening, the unit being secured to said atomizing fluid delivery tube, said cylindrical tip being inserted in said opening such that the tip of the nozzle terminates in a plane including the downstream end of said unit.

2. Burner according to claim 1, wherein said liquid fuel delivery tube includes at least one cylindrical tube.

3. Burner according to claim 1, wherein the tip angle of the cone is at least 30°.

4. Burner according to claim 1, wherein said at least one atomizing element further comprises at least one component which substantially closes the liquid fuel delivery tube and is perforated by cylindrical channels which are oblique with respect to the delivery direction of the liquid fuel.

5. Burner according to claim 4, wherein said channels are uniformly distributed over the circumference of the at least one component.

6. Burner according to claim 4, wherein said component is a cylinder with two sides which are approximately parallel to one another.

7. Burner according to one of the claim 4, wherein each of said channels makes an angle α of at least 10° with the delivery direction of the liquid fuel.

8. Burner according to claim 4, wherein said component is positioned at a stop against the swirling chamber.

9. Burner according to claim 1, wherein said injector is installed in an airtight manner in a unit made of refractory material via a sealing arrangement which includes a plate provided with cooling fins.

10. Burner according to claim 9, further comprising an adjustable support which supports said injector, and a ventilation fluid nozzle which is oriented toward the downstream end of said injector.

11. Burner according to one of the claim 4, wherein each of said channels makes an angle α of between 15 and 30° with the delivery direction of the liquid fuel.

12. Burner according to one of the claim 4, wherein each of said channels makes an angle α equal to 20° with the delivery direction of the liquid fuel.

13. Burner according to claim 1, wherein said opening includes a conical portion having projecting portions which engage the truncated cone shape to ensure self centering of said tip inside said opening.

* * * * *